US007598936B2

(12) United States Patent
Hoshino

(10) Patent No.: US 7,598,936 B2
(45) Date of Patent: Oct. 6, 2009

(54) LIQUID CRYSTAL DISPLAY DEVICE

(75) Inventor: Masafumi Hoshino, Chiba (JP)

(73) Assignee: Seiko Instruments Inc. (JP)

( * ) Notice: Subject to any disclaimer, the term of this patent is extended or adjusted under 35 U.S.C. 154(b) by 668 days.

(21) Appl. No.: 11/004,782

(22) Filed: Dec. 3, 2004

(65) Prior Publication Data

US 2005/0122299 A1 Jun. 9, 2005

(30) Foreign Application Priority Data

Dec. 5, 2003 (JP) ..... 2003-407625

(51) Int. Cl.
*G09G 3/36* (2006.01)

(52) U.S. Cl. ..... 345/87; 345/98

(58) Field of Classification Search ..... 345/87–100, 345/204

See application file for complete search history.

(56) References Cited

U.S. PATENT DOCUMENTS 6,975,298 B2 * 12/2005 Koyama et al. ..... 345/98
7,084,848 B2 * 8/2006 Senda et al. ..... 345/92
7,180,496 B2 * 2/2007 Koyama et al. ..... 345/98
7,268,766 B2 * 9/2007 Kim et al. ..... 345/102
2002/0163493 A1 * 11/2002 Matsushima et al. ..... 345/98
2004/0012696 A1 * 1/2004 Teratani et al. ..... 348/246
2004/0041771 A1 * 3/2004 Murase et al. ..... 345/98
2004/0196235 A1 * 10/2004 Koyama et al. ..... 345/89
2005/0041006 A1 * 2/2005 Lee et al. ..... 345/99

* cited by examiner

*Primary Examiner*—Nitin I. Patel
(74) *Attorney, Agent, or Firm*—Adams & Wilks

(57) ABSTRACT

Pixel electrode driver circuit is disclosed, which include a data signal line, a first latch circuit composed of a three-stage shift circuit, and a second latch circuit connected to each latch, and in which each output of the second latch circuit is connected to each of electrodes corresponding to pixels in respective colors of red, green, and blue to thereby drive every 2 to 32 electrodes in a time division manner. Further, the pixel electrode driver circuit has a positive power supply connected to a control line of the latch circuit for power supply, and two pairs of wirings extending in vertical and horizontal directions and consisting of a data signal line and one control line, and another control line and a GND line are used for connection to the pixel electrode substrate. Further, the pixel electrode driver circuits have a mirror-symmetry suitable for substrate formation by an FSA method.

9 Claims, 6 Drawing Sheets

LIQUID CRYSTAL DISPLAY DEVICE

BACKGROUND OF THE INVENTION

1. Field of the Invention

The present invention relates to a structure of a liquid crystal display where a driver circuit is provided for pixels as in a Thin Film Transistor (TFT) liquid crystal display, and where a relatively small number of rows are driven in a time division manner.

2. Description of the Related Art

Driving method for a liquid crystal display is classified into a method for passive-matrix or a method for active matrix. A passive matrix liquid crystal display device has been employed for a display targeted for still image display such as a PDA, because of its simple structure and cost effectiveness. On the other hand, an active matrix liquid crystal display device, which can realize a high contrast ratio display as well as a multi-color display with ease, has been widely used for a personal computer, workstation, or the like.

The passive matrix liquid crystal display device is constructed such that a liquid crystal layer is held between a group of row electrodes and a group of column electrodes, and pixels are arranged in matrix. A pixel unit composed of plural electrodes is driven in a time division manner. Example of driving method includes voltage averaging method, smart addressing (SA) method, and multi-line addressing (MLA) method.

The active matrix liquid crystal device has such a structure that active elements turn individual pixels ON/OFF to display an image, and is represented by a TFT display which uses transistors as active elements. As a driving method for a TFT liquid crystal display, the following three methods have been mainly put into practical use; a dot inversion driving method, a line inversion driving method, and a frame inversion driving method. In these methods polarity of an AC signal is inverted on every pixel, every scanning line, and every frame, respectively. Among those, the dot inversion driving method offers the highest display quality. The line inversion driving method offers the second highest display quality and somewhat causes crosstalk. The frame inversion driving method causes large crosstalk in a vertical direction, leading to a non-uniform image with a brightness gradient in a vertical direction on a screen. On the other hand the frame inversion driving method consumes the lowest power. The line inversion driving method consumes power about three times the power in the frame inversion driving method. The dot inversion driving method consumes power about six times the power in the frame inversion driving method. If an effective AC inversion period is shortened by switching the AC signal applied to a liquid crystal at every pixel or at every scanning line in these driving methods which have lower display qualities, the polarity of the signal applied to the liquid crystal changes area by area, thereby flickering of the screen is reduced (see JP 05-029916 B, for example).

Amorphous silicon or poly-crystalline silicon has been used widely as a substrate for a TFT liquid crystal display. Hereinafter a-Si TFT is used for a TFT formed on an amorphous silicon substrate and p-Si TFT for a TFT formed on a poly-crystalline silicon substrate. In recent years, however, a liquid crystal display device using crystalline silicon as a TFT substrate (hereinafter c-Si TFT) is coming into the market.

Typical manufacturing methods for the c-Si TFT are:

(1) Forming an image display portion where transistors are arrayed directly on a c-Si wafer and using the resultant as a display driving substrate as it is;

(2) Forming a display driving substrate by forming an image display portion where transistors are arrayed directly on the c-Si wafer and then bonding the surface having the circuit formed thereon onto a glass substrate, followed by grinding/polishing the rear surface to connect a pixel electrode through wiring; and (3) Forming a display driving substrate by forming a transistor circuit element on a c-Si wafer, grinding/polishing the wafer into a thin film, separating the transistor circuit elements from one another by anisotropic etching, arranging the separated transistor circuit element in a hole corresponding to the image display portion on the substrate in a liquid, and then forming an electrode. In addition to the above methods, for example, laser annealing of amorphous silicon is currently under study (see "Information Display: Vol. 15, No. 11, November 1999" for example).

In time-division driving as in the passive matrix driving, as the number of row electrodes increases, an ON/OFF ratio of an effective voltage applied to the liquid crystal reduces, resulting in a low contrast. Accordingly, there is a limitation on the number of row electrodes to which a voltage can be applied in practical use. Hence, disadvantageously, the passive matrix is not suitable for a panel having a larger size. Meanwhile, in the case of the active matrix driving, an AC signal is used for driving, resulting in flickering on the screen. If the dot inversion driving is adopted to reduce the flicker, the power consumption disadvantageously increases.

As regards a substrate on which a TFT is integrated, a conventional liquid crystal display device using a-Si TFT or p-Si TFT can produce a low-cost, large-area liquid crystal display device. However, because of a low mobility of the transistor, there is a disadvantage in that the device neither reduces an element size nor allows a high-speed operation. According to the method using the c-Si wafer itself as an image display region, electrons/holes leak in the wafer thickness direction or a floating capacitor is formed in the same direction, for example. Thus, with the method, the transistor is incapable of operating at a high speed in comparison with other methods using single-crystal silicon. Also, the method requires the c-Si wafer having the same area as that of the display panel and thus is disadvantageous in that it is not suitable for the panel with a larger size or lower cost.

Further, in a method where the transistor circuit elements are formed on the c-Si wafer, the wafer is ground/polished into a thin film, and the transistor circuit elements are separated by anisotropic etching and then arranged on the substrate in a liquid, it is unnecessary to form a portion other than the transistor circuit such as a wiring in a c-Si process. As a result, a liquid crystal display device using a c-Si TFT can be manufactured at a relatively low cost. However, there is a disadvantage in that the separated transistor circuit element has a large size, narrowing a transparent electrode formation region and reducing an opening ratio. Also, in the case where the elements are arranged in the pixels in a one-to-one correspondence, the c-Si TFT is higher in cost than the a-Si TFT.

SUMMARY OF THE INVENTION

The present invention has been made to solve the above-mentioned problems, and therefore has an object to provide a liquid crystal display device with a simple structure, low power consumption, and a high display quality.

According to the present invention, pixel electrode driver circuits are used, which include a first latch circuit composed of a three-stage shift circuit provided to a pixel electrode substrate and a second latch circuit connected to each latch, and in which each output of the second latch circuit is connected to each of electrodes corresponding to pixels in respective colors of red, green, and blue, and the pixel electrode connected in series to the output of the second latch circuit and a opposing electrode formed on a opposing electrode substrate are used to drive every 2 to 32 electrodes in a time division manner. Thus, the present invention solves the above-mentioned problem.

Further, the positive power supply for the pixel electrode driver circuit is supplied from a control line of the latch circuit, and two pairs of wirings, one pair of wirings extending in vertical direction and consisting of a data signal line and a control line, and another pair of wirings extending in horizontal direction and consisting of another control line and a GND line, are used for connection to the pixel electrode substrate. Further, the pixel electrode driver circuits have mirror symmetry to attain a structure suitable for substrate formation by Fluidic Self Assembly (FSA) method.

As described above, according to the present invention, it is possible to provide a liquid crystal display device which realizes a high-contrast display quality and low power consumption, and is free of crosstalk that may occur in a TFT such that a liquid crystal display is driven at a low duty ratio by 2 to 32 electrodes each, in a time division manner using plural pixel electrode driver circuits. In addition, since one pixel electrode driver circuit is constructed such that latch circuits in three colors of red, green, and blue are driven by 2 to 32 electrodes each, in a time division manner and formed on the pixel electrode substrate by the FSA method, the number of pixel electrode driver circuits can be reduced considerably and the manufacturing cost for the liquid crystal display device can also be reduced.

DETAILED DESCRIPTION OF THE PREFERRED EMBODIMENTS

Figure 1:
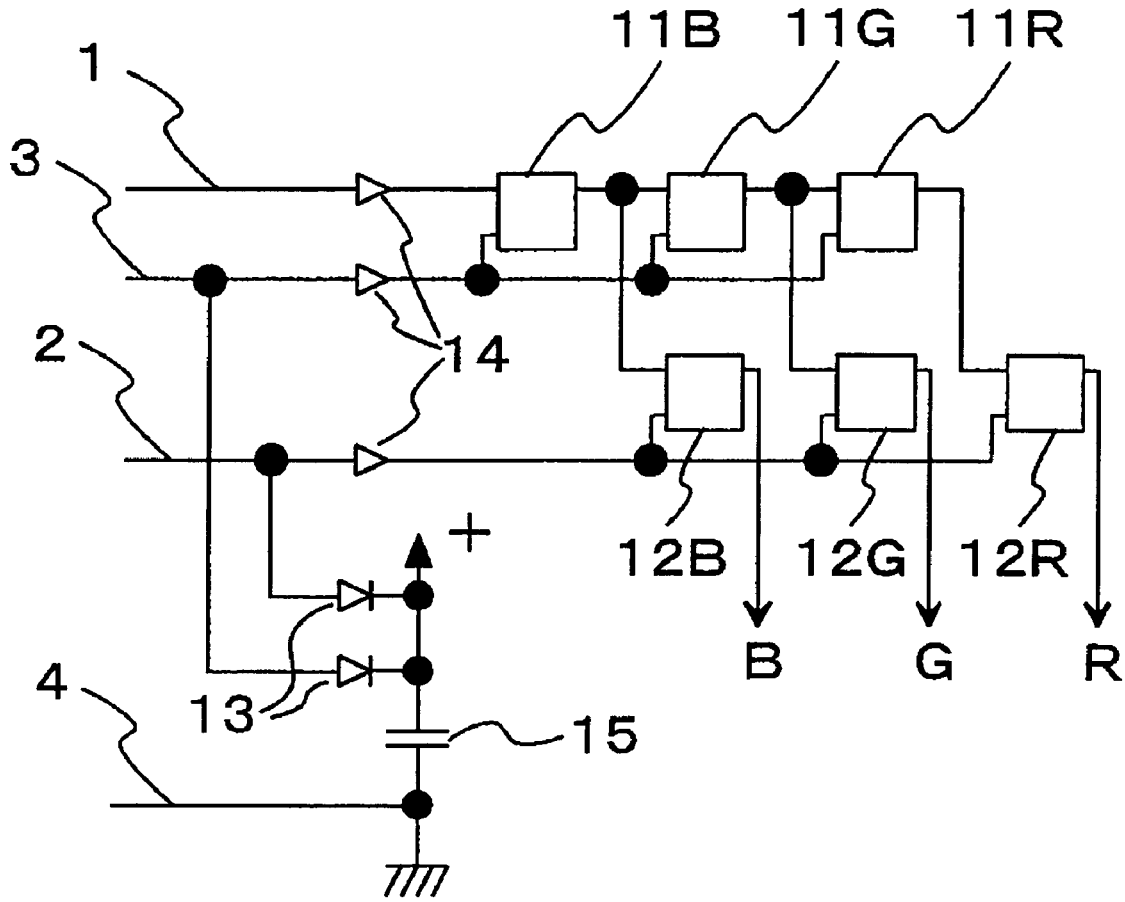
FIG. 1 is a circuit diagram showing a pixel electrode driver circuit according to the present invention.

In a pixel electrode driver circuit of a liquid crystal display device according to the present invention, as shown in FIG. 1, a first latch circuit whose input is a data form a data signal line 1 includes a three-stage shift circuit corresponding to red, green, and blue, and latches data corresponding to each color in response to a signal from a first control line 3. Then, an output terminal of the first latch circuit is connected to an input terminal of a second latch circuit to latch data corresponding to red, green, and blue in response to a signal from a second control line 2 and sends the latched data to a red (R) terminal, a green (G) terminal, power supply is connected to a terminal 4. Since the positive power is supplied from the first and second control lines, diodes 13 are disposed.

Figure 2:
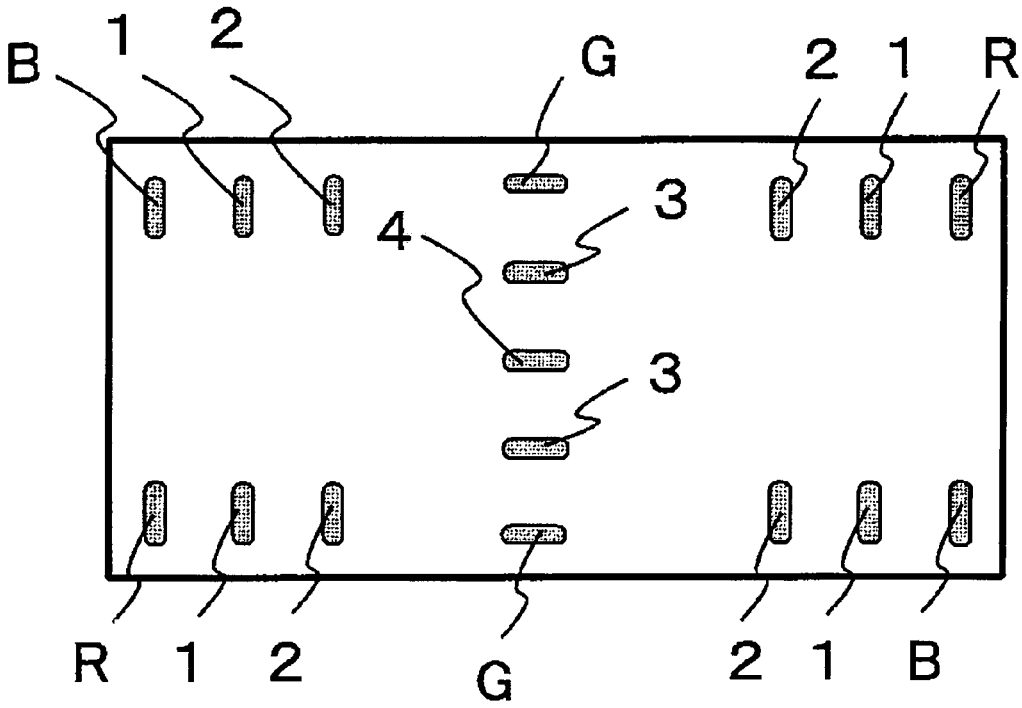
FIG. 2 is an appearance diagram showing a chip of the pixel electrode driver circuit according to the present invention.

FIG. 2 is an appearance drawing showing a chip for the pixel electrode driver circuit according to the present invention. In FIG. 2, each reference symbol indicates a terminal to which a wiring assigned by the corresponding reference symbol of FIG. 1 is connected. Since the each terminal is arranged point-symmetrically, the chip works even if it is installed upside down in a hole of the pixel electrode substrate by the FSA method. It is possible to devise the chip shape so as to be disposed in only a predetermined direction.

Figure 3:
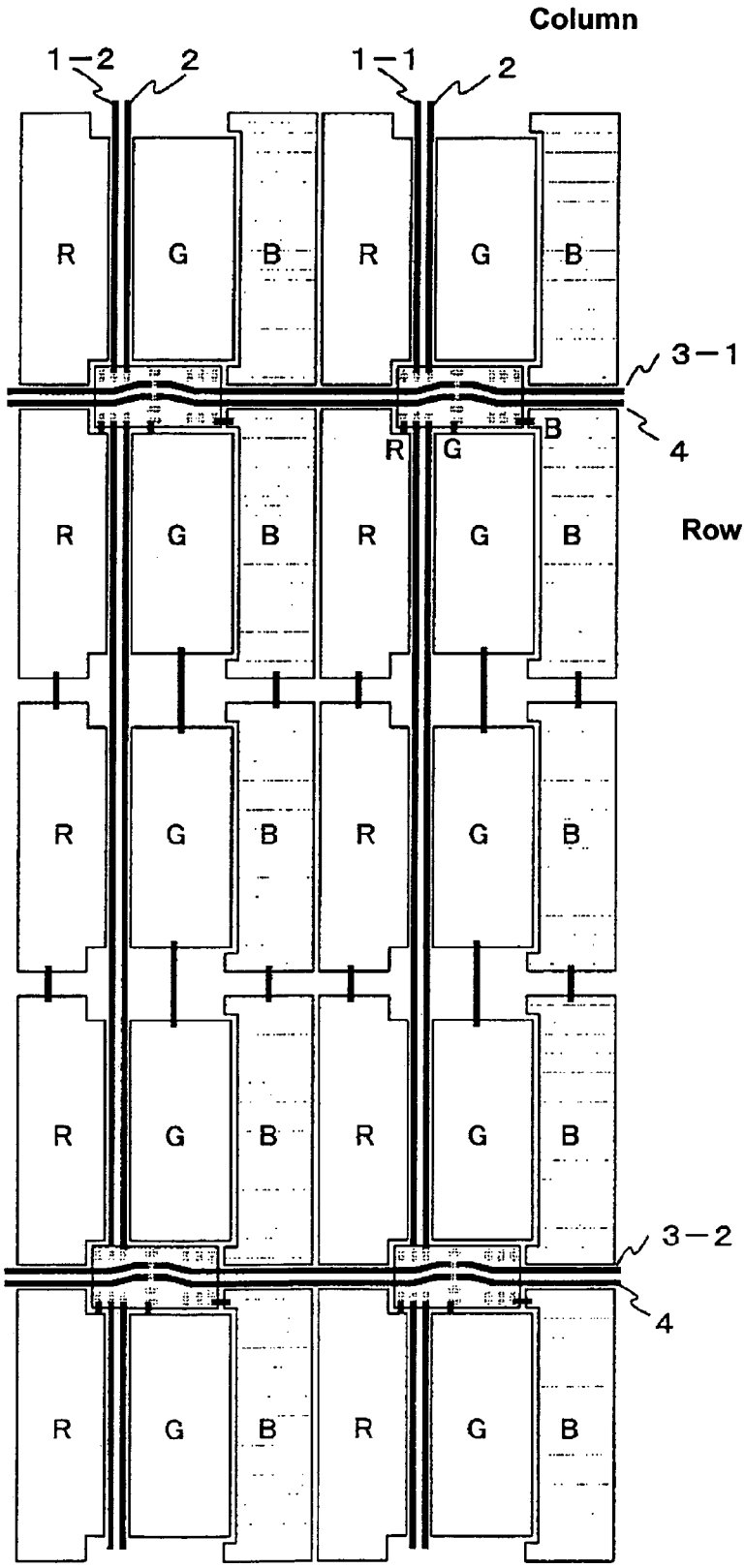
FIG. 3 is a detailed drawing showing a pixel electrode substrate according to the present invention.

FIG. 3 shows an example of a pixel electrode substrate formed by the FSA method. In the example of FIG. 3, one pixel electrode driver circuit is arranged for every three rows, and connected with two sets of metal wirings made of Cr, Mo, etc. both in vertical direction and horizontal direction. Output terminals of R, G, and B are connected to column electrodes corresponding to three columns and composed of transparent electrodes made of ITO etc. Since the positive power supply for the pixel electrode driver circuit is supplied by the control line for the latch circuit, configuration takes a form in which two pairs of wirings, one pair of wirings extending in vertical direction and consisting of a data signal line and a control line, and another pair of wirings extending in horizontal direction and consisting of another control line and a GND line, are used for connection to the pixel electrode substrate.

Figure 4:
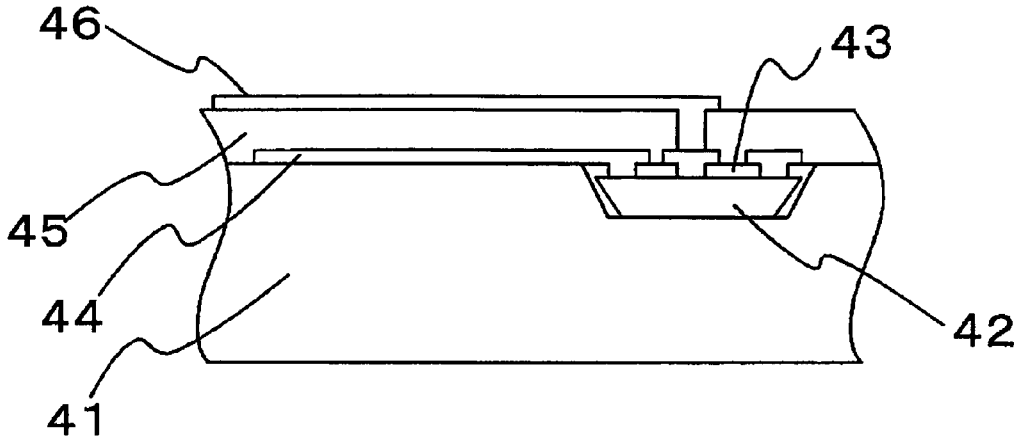
FIG. 4 is a sectional view showing the pixel electrode substrate according to the present invention.

FIG. 4 is a sectional view showing the pixel electrode substrate of the present invention. A pixel electrode driver circuit 42 is arranged in a substrate 41 made of plastics etc., on which a planarization film 43, a first-layer wiring 44, an insulating film 45, and a second-layer wiring 46 are formed. In this embodiment, in order to increase an opening ratio and reduce power consumption, employed is a two-layer structure where the first-layer wiring 44 and the second-layer wiring 46 are laminated while sandwiching the insulating film 45. It is possible to use a single-layer structure where the first-layer wiring 44 and the second-layer wiring 46 are formed in the same layer insofar as an area per pixel becomes large and a wiring region is easily ensured.

Figure 5:
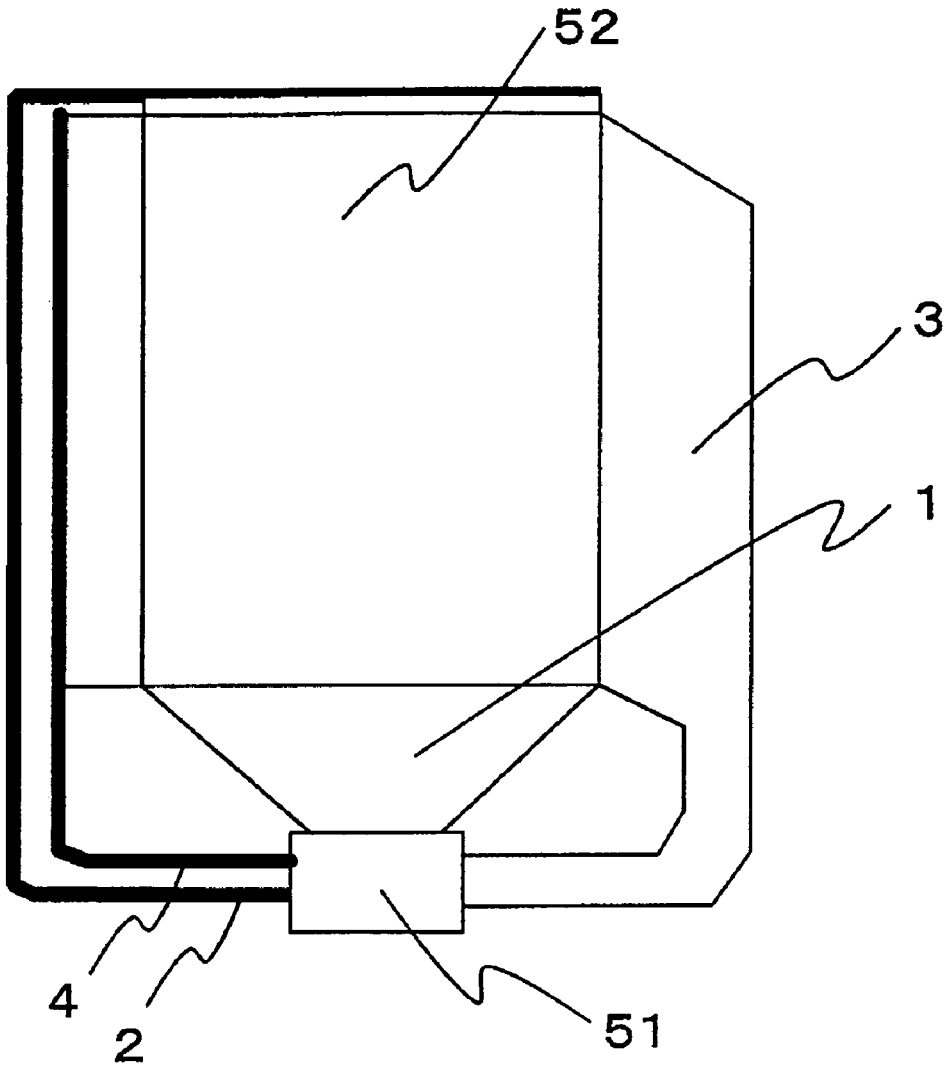
FIG. 5 shows how to wire a drive IC and a liquid crystal display according to the present invention.

FIG. 5 shows wire connection between a liquid crystal display and a driver IC. The driver IC 51 and the display portion 52 are connected on a column basis through a data signal line 1 and on a row basis through a control line 3, with a second control line 2 and a GND 4 being integrated into one respectively outside the display portion. For example, in the case of a color liquid crystal display having 162 rows×128 columns×3 (RGB) pixels, the 128 data signal lines 1, the 54 first control lines 3, the one second control line 2, the one GND 4, and 3 lines for row electrodes of an opposing substrate, in total, 187 lines are used.

Figure 6:
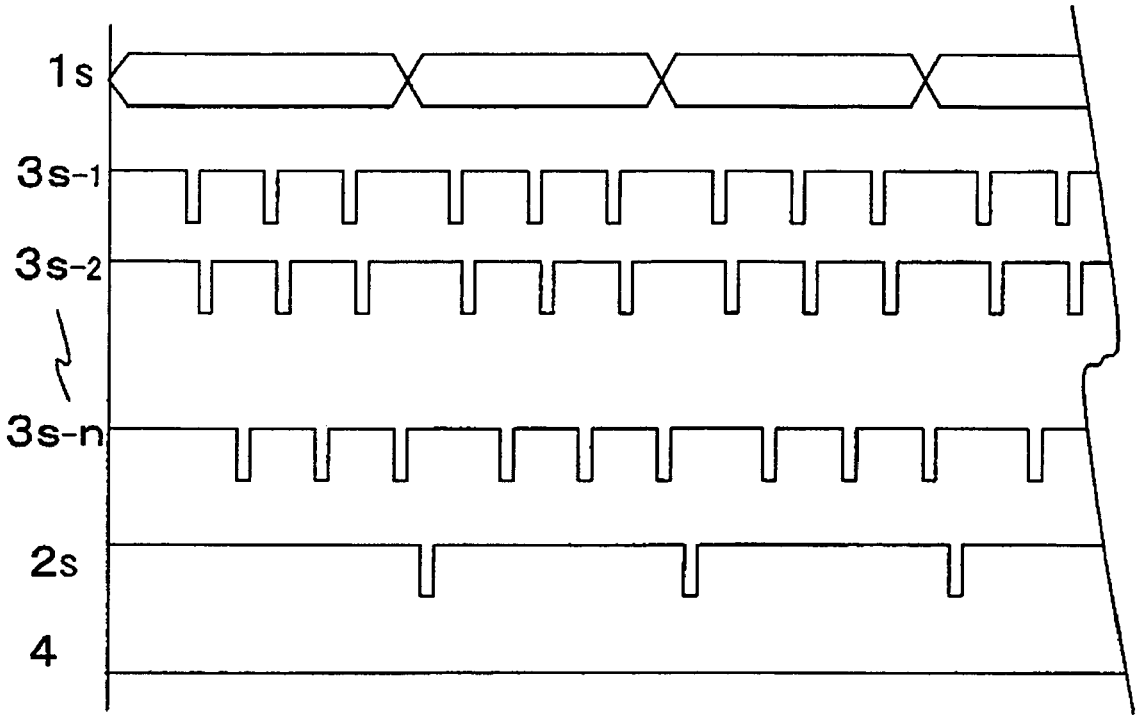
FIG. 6 is a drive waveform chart of the pixel electrode driver circuit according to the present invention.

Referring next to a drive waveform chart of the pixel electrode driver circuit of the present invention in FIG. 6, an operation will be described. A data signal 1*s* of image data for ON/OFF-control of each pixel is entered to the data signal line 1 for each column of the pixel electrode substrate. First, blue image data is entered in order from the first row forward and latched to a first latch circuit 11B on each row in response to first control signals 3*s*-1 to 3*s*-n. Next, green image data and red image data are repeatedly latched to first latch circuits 11G and 11R and shifted in a similar way, so data is latched to the first latch circuits corresponding to respective colors. Thereafter, data is latched to second latch circuits 12B, 12G, and 12R in response to a second control signal 2*s* and outputted to the terminals B, G, and R. In this embodiment, the first latch circuit is composed of the three-stage shift circuit corresponding to red, green, and blue, but m-stage (m is 1 or more) shift circuit may be used.

The above operation corresponds to a period necessary for representing one gray scale. Repeat operation of this period up to the number of gray scale consists one selection period. Further, the column electrodes are driven by three columns each in a time division manner and thus driven at a duty ratio of 1/3. One frame period is three times as long as one selection period. For example, in the case where the liquid crystal display having 162 rows×128 columns (RGB) is driven at a frame frequency of 60 Hz and 32 gray scales, one frame period equals 16.7 ms, one selection period equals 5.6 ms, and one gray scale period equals 174 μsec. Data is written 162 times in one gray scale period and thus has only to be written once in a period of 1.07 μs. At this time, it is possible to reduce power consumption by minimizing the amplitude of the data signal. In this embodiment, time-division driving is carried out using three divisions. It is possible to perform time-division driving using any of 2 to 32 divisions. At this time, in general, 2 to 4 divisions may be used for a TN liquid crystal, 5 to 10 divisions may be used for an HTN liquid crystal (obtained by twisting a TN liquid crystal by 90 degrees or larger), and 11 or more divisions may be used for the STN liquid crystal.

In the present invention, display mode of the liquid crystal is not limited to the aforementioned mode but may be homeotropic or Optical-mode Interference (OMI) mode. Also, an organic Electro-luminescence (EL) and the like may be used when the driving at a low duty ratio is a main concern.

In addition, the SA driving method and PWM (Pulse Width Modulation) are used here as the driving method and the gray scale control, respectively, but the voltage averaging method, the MLA method, the frame rate control (FRC) gray scale method, or the like can also be used without difficulty.

The pixel electrode substrate of this embodiment is formed by arranging the pixel electrode driver circuit formed of c-Si in a hole of the pixel electrode substrate using the FSA method. However, other methods can also be used. For example, if continuous grain boundary silicon is used for forming the circuit, where a p-Si thin film is used to enlarge grain boundaries and interfaces are aligned to improve the mobility, the same effects can be obtained.

What is claimed is:

1. A liquid crystal display device, comprising:

a pixel electrode substrate and an opposing electrode substrate which are arranged so as to oppose with each other;

a liquid crystal layer formed between the pixel electrode substrate and the opposing electrode substrate;

a plurality of pixel electrodes formed on the pixel electrode substrate, which are arranged in matrix and are comprised of row electrodes and column electrodes;

a plurality of pixel electrode driver circuits formed at intersections of the row electrodes and the column electrodes; and an opposing electrode formed on the opposing electrode substrate, wherein the pixel electrode driver circuit comprises: a first latch circuit that receives a data signal and a first control signal; and a second latch circuit that receives an output of the first latch circuit and a second control signal, and performs a time division drive by using the plurality of pixel electrodes which are connected in series to the outputs of the second latch circuit and the opposing electrode.

2. A liquid crystal display device according to claim 1, wherein the first latch circuit is comprising m-stage shift circuit where m is an integer equal to or larger than 1, the second latch circuit is comprising m-stage shift circuit, and each output of the m latch circuit is connected to each of the pixel electrodes which are divided into m.

3. A liquid crystal display device according to claim 2, wherein the m-stage shift circuit comprises a three-stage shift circuit, each of the outputs of the second latch circuits connected to an output of the three-stage shift circuit is connected to each of the pixel electrodes corresponding to pixels in respective colors of red, green, and blue.

4. A liquid crystal display device according to claim 1, wherein the plurality of pixel electrodes which are connected in series comprise 2 to 32 pixel electrodes.

5. A liquid crystal display device according to claim 1, wherein the time division drive is a synchronous drive for every plurality of pixel electrodes therewith, which are connected in series.

6. A liquid crystal display device according to claim 1, wherein a positive power supply for the pixel electrode driver circuit is supplied from a first control signal line and a second control signal line.

7. A liquid crystal display device according to claim 1, wherein the pixel electrode substrate has a first pair of wirings extending in vertical direction and a second pair of wirings extending in horizontal direction.

8. A liquid crystal display device according to claim 7, wherein the first pair of wirings comprises a line for the data signal and the second control signal line, the second pair of wiring comprises the first control signal line and a GND line.

9. A liquid crystal display device according to claim 1, wherein the pixel electrode driver substrate is formed by using an Fluidic Self Assembly (FSA) method.

* * * * *

UNITED STATES PATENT AND TRADEMARK OFFICE

CERTIFICATE OF CORRECTION

PATENT NO. : 7,598,936 B2
APPLICATION NO. : 11/004782
DATED : October 6, 2009
INVENTOR(S) : Masafumi Hoshino It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1268 days.

Signed and Sealed this

Twenty-eighth Day of September, 2010

David J. Kappos

David J. Kappos
*Director of the United States Patent and Trademark Office*